United States Patent [19]

Robillard

[11] Patent Number: 4,699,872

[45] Date of Patent: Oct. 13, 1987

[54] NON-SILVER PHOTOSENSITIVE ARTICLE AND PROCESS

[76] Inventor: Jean J. A. Robillard, 28, Beechwood Rd., Castletroy, Limerick, Ireland

[21] Appl. No.: 798,374

[22] Filed: Nov. 15, 1985

[30] Foreign Application Priority Data

Nov. 15, 1984 [IE] Ireland ..... 2941/84

[51] Int. Cl.[4] ..... G03C 1/72

[52] U.S. Cl. ..... 430/336; 430/340; 430/344; 430/966; 430/967

[58] Field of Search ..... 430/336, 338, 966, 967, 430/340, 344; 346/218

[56] References Cited

U.S. PATENT DOCUMENTS

| | | | |
|---|---|---|---|
| 4,394,439 | 7/1983 | Robillard | 430/344 |
| 4,465,761 | 8/1984 | Takegawa et al. | 430/343 |
| 4,500,897 | 2/1985 | Matsuda et al. | 346/218 |

OTHER PUBLICATIONS

Nath et al.: *Further Studies on the Solid-State Chemistry of irradiated Choline Chloride,* Journal of Chemical Physics, vol. 61, 1974, pp. 1542–1547.

*Primary Examiner*—Won H. Louie

*Attorney, Agent, or Firm*—Birch, Stewart, Kolasch and Birch

[57] ABSTRACT

A photosensitive article comprises a substrate of a triacetate or other polyester film or paper coated with a layer of a photosensitive composition. The photosensitive composition includes at least one photodissociable choline compound sensitive to x-rays or radiation of shorter wave lengths, at least one image-forming compound capable of producing a dye by reaction with the dissociation products of the choline compound, a water soluble polymeric binder and a low melting point fatty acid salt for heat development. The photosensitive article can be used to produce an x-ray image by exposing the article image-wise to x-rays and heating the exposed article to develop the image.

19 Claims, No Drawings

NON-SILVER PHOTOSENSITIVE ARTICLE AND PROCESS

This invention relates to a non-silver photosensitive article and process applicable to x-rays and shorter wavelength radiation including gamma rays. More specifically it relates to an article and process employing radiation induced dissociation of certain organic compounds by irradiation with x-rays or other radiation of shorter wavelengths, to the exclusion of radiator of longer wavelengths including infrared, visible and ultraviolet.

Most of the x-ray recording techniques currently used are based on silver halide. They are used extensively for medical purposes and non destructive testing.

Silver halide films, however, are also sensitive to visible light and must therefore be handled in the dark. They also require wet chemical development which precludes an immediate access to the record.

The only practical non-silver technique used for x-ray recording is Xerography. The principle is similar to that of Xerox photocopying in which an electrostatically charged selenium plate is exposed to the x-ray image whereby the radiation causes the charges to leak through the plate in the exposed area. The remaining charged pattern is then used to attract toner particles forming a positive image which is then transferred onto a paper substrate. However, the sensitivity of x-ray Xerography is close to that of silver halide films, and while it is a dry process it requires a physical development in complicated processing equipment. It also provides a positive image on a opaque substrate, which is not readily accepted by physicians who are accustomed to negative transparencies.

It is an object of the present invention to provide an article and process for x-ray imaging based on the photodissociation of certain organic compounds to initiate a color forming reaction and wherein prints of good contrast and density are produced solely by the action of the exposing radiation followed by a simple heat treatment without liquid development.

A further object of the invention is to provide such article and process which are not inherently sensitive to visible radiation, and have a higher sensitivity to x-rays than conventional silver halide x-ray recording techniques.

According to the invention there is provided a photosensitive article comprising a substrate coated with a layer of a photosensitive composition including:

a photodissociable choline chloride which is sensitive to x-rays or radiation of shorter wavelength, at least one image-forming compound capable of producing a dye by reaction with the dissociation product of the choline chloride, a water soluble polymeric binder, and a low melting point wax for heat development.

Various additives such as sensitivity improvers, surfactants, basic materials for pH adjustment, fillers, lubricants, etc. may be added as required.

The invention is based on the discovery that choline chloride has a very high sensitivity to short wavelength radiation which produce a chain decomposition with very high yield (more than 500 molecules decomposed by eV absorbed).

The reaction of photodissociation can be written:

$$(CH_3)_3NCH_2CH_2OHCl \xrightarrow{h\nu} (CH_3)_3N.HCl + CH_3CHO$$

It is a chain reaction whose mechanism is rather complex, involving trapped electrons and holes and biradicals (Nath. A et al, Jl of Chem. Phys. 61, 1542, 1974).

The acidic compound $(C_3)_3N.HCl$ resulting from the photdissociation of choline chloride can be used to promote a color change in a dye forming reaction.

The above remarkable sensitivity of choline chloride to x-rays and other ionizing radiations, resulting in a chain reaction producing an acidic compound and the use of that compound to cause a change of color in a dye forming composition, are the basis of the invention.

The photodissociable choline compound used in this invention is preferably choline chloride in the crystalline state with an average particle size less than 5 μm.

The image-forming compound may be a lactone, but any compound reacting with a weak acid to form a dye such as, for example, an acid indicator, would serve the purpose. However, lactone compounds are well known as image-forming compounds in a variety of systems including thermosensitive papers and pressure sensitive papers. In addition to providing a coloration they also provide stability of the final image under various conditions (light exposure, humidity, temperature etc.). They are also well adapted to thermal development by increasing mobility of the reactants due to the low melting point of the binder. All these features which work well on existing systems class these products as preferential candidates for the present invention.

Typical image-forming compounds used in this invention are phthalide, leucauramine and fluoran compounds and the following are cited as typical examples: crystal violet lactone, malachite green lactone, pyridyl blue, 3,3 bis (paradimethylaminophenol)-4,5,6,7-tetrachlorophthalide, 3-ethylamino-6-chlorofluoran, and 3-pyrrolidino-6-methyl-7-anilinofluoran.

All the compounds listed above are lactones except for pyridyl blue which is a mixture of the isomers, 7-(1-ethyl-2-methylindol-3-yl)-7-(4-diethylamino-2-ethoxyphenyl)-5,7-dihydrofuro(3,4b) pyridin-5-one, and 5-(1-ethyl-2-methylindol-3-yl)-5-(4-diethylamino-2-ethoxyphenyl) 5–7 dihydrofuro(3,4b) pyridin-7-one. (Rees. A, Color Chemistry, McGraw Hill, 1947). Pyridyl blue is used extensively in thermoreactive papers for facsimile and medical recording.

The fluoran compounds referred to are a class of xanthene dyes with the general structure:

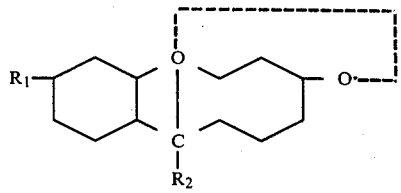

wherein $R_1$ and $R_2$ are optional substituents.

The binders used in the invention are water soluble, polymeric material such as: polyvinylalcohol, hydroxyethylcellulose, starch, carboxymethylcellulose, methylcellulose, isopropylcellulose, gelatin, casein, gum arabic or latex materials including polystyrene, polyacrylate and polyvinyl acetate.

Materials for heat development used in the present invention are waxes with a low melting point which increases the ionic mobility in the photosensitive layer when the temperature is raised over a certain threshold and hence allow the color-forming reaction to take place. Low melting point fatty acid amide waxes are preferred, but other fatty acid salts act similarly although the amide is more compatible with the dye precursors. Typical low melting waxes include Shellac, carnauba wax, paraffin wax and polyethylene wax. A development temperature of between about 100° C. and about 200° C. may be used with the examples cited. It represents the temperature at which the low melting point wax starts to melt thereby providing the ionic mobility necessary to the propagation of the colour-forming reaction. The duration of development is from about 0.5 to about 10 seconds.

Sensitivity improvers which can be used in the present invention are materials with high absorption for x-rays such as $Pb_2O_3$ and $UO_2$.

Surfactants which may be used in the photosensitive composition include Alipal CO 436 (GAF), Duponel (Dupont), Igepon AP-78 (GAF), Nacconol (Allied Chemical) and Nekal BX 78 (GAF). Alipal CO 436, Duponel, Igepon AP-78, Nacconol and Nekal BX 78 are all trade marks. Materials for pH adjustment in the photosensitive composition are organic based, preferably aliphatic amines, such as methylamine, trimethylamine, ethylmethylpropylamine and hexamethylenetetramine.

Filler material which can be used in the invention are titanium dioxide, zinc oxide, calcium carbonate, silicon dioxide and aluminium trioxide.

Lubricants are materials which improve the rheology of the coating material, and they include zinc stearate, zinc naphthenate, lead naphthenate, barium stearate and barium naphthenate.

The photosensitive composition used in this invention may be formed according to normal methods of emulsion preparation, all the materials preferably having a particle size less then 5 μm, the emulsion then being coated on an appropriate substrate.

The substrate for the layer of photosensitive composition can be triacetate or other polyester films, or paper. The coating may be made by conventional coating techniques such as reverse rolls, knife edge, Meyer bars. It can subsequently be calendered to improve surface smoothness. The coating weight of the composition is preferably in the range from about 0.5 to about 5.0 grams per square meter.

The invention is now described in further detail by way of some examples. It is to be understood, however, that the scope of this invention is not limited by these examples. In the examples, the quantities are parts by weight.

EXAMPLE 1

The following compositions A and B were prepared separately by mixing the ingredients and homogenizing in a Silverson Mixer Emulsifier:

| | | |
|---|---|---|
| Composition A | Choline chloride | 40 |
| | Hydroxyethylcellulose | 18.8 |
| | Lead oxide | 20 |
| | Water | 316 |
| | Igepon AP-78 | 0.1 |
| Composition B | Crystal violet lactone | 6 |
| | Hydroxyethylcellulose | 11.2 |
| | Water | 85 |
| | Igepon AP-78 | 0.1 |
| | Zinc stearate | 2 |
| | Acrawax | 2 |

Compositions A and B were thoroughly mixed together and coated on a paper surface with an air knife coater to provide a coating of 5 g/m$^2$ in the dry state.

After drying the paper was exposed image-wise to x-ray radiation and provided a dark blue image with a maximum density of 1.8, when exposed and developed under the following conditions:

| | |
|---|---|
| Distance paper-source | 50 cm |
| Voltage | 150 KV |
| Current | 6 mA |
| Exposure time | 4 sec. |
| Development temperature | 100–200° C. |
| Development speed | 6 cm/sec. (equivalent to a development time of 1 sec.) |

(Note: Development speed is the speed at which the substrate moves under the heat source during development. The temperature chosen within the range 100–200° C. is determined by the image density and contrast desired)

EXAMPLE II

The following compositions A and B were prepared separately by mixing the ingredients and homogenizing in a Silverson Mixer Emulsifier:

| | | |
|---|---|---|
| Composition A | Choline chloride | 50 |
| | Hydroxyethylcellulose | 12.5 |
| | Water | 240 |
| | Nekal BX-78 | 0.1 |
| Composition B | 3-Ethylamino-6-chlorofluoran | 10 |
| | Hydroxyethylcellulose | 10 |
| | Water | 190 |
| | Nekal BX-78 | 0.1 |
| | Fatty acid amid S | 30 |

The compositions A and B were thoroughly mixed together and coated on a nylon sheet with a Meyer bar to provide a coating of 5 g/m$^2$ in the dry state.

After drying the film was exposed to x-ray radiation and provided a dark brown image with a maximum density of 1.4 when exposed under the following conditions:

| | |
|---|---|
| Distance film-source | 50 cm |
| Voltage | 150 KV |
| Current | 6 mA |
| Exposure time | 3 sec. |
| Development temperature | 100–200° C. |
| Development speed | 6 cm/sec. |

EXAMPLE III

The following compositions A and B were prepared separately by mixing the ingredients and homogenizing in a Silverson Mixer Emulsifier:

| | | |
|---|---|---|
| Composition A | Choline chloride | 40 |
| | Polyvinylalcohol | 20 |
| | Lead oxide | 20 |
| | Hexamethylenetetramine | 5 |
| | Water | 315 |
| | Nacconol | 0.1 |

-continued

| | | |
|---|---|---|
| Composition B | Pyridyl blue (leuco) | 6 |
| | Polyvinylalcohol 10 | |
| | Water | 85 |
| | Nacconol | 0.1 |
| | Zinc stearate | 2 |
| | Acra Wax C | 2 |

Compositions A and B were thoroughly mixed together and coated on a paper surface with a reverse roll coater to provide a coating of 5 g/m$^2$ in the dry state.

After drying the paper was exposed to x-ray radiation and provided a dark blue image with a maximum density of 1.6 under the following conditions:

| | |
|---|---|
| Distance to the source | 50 cm |
| Voltage | 150 KV |
| Current | 6 mA |
| Exposure time | 1 sec. |
| Development temperature | 100-200° C. |
| Development speed | 6 cm/sec. |

EXAMPLE IV

The following compositions A and B were prepared separately by mixing the ingredients and homogenizing in a Silverson Mixer Emulsifier:

| | | |
|---|---|---|
| Composition A | Choline chloride | 40 g |
| | Methylhydroxypropyl-cellulose | 10 |
| | Hexamethylenetetramine | 5 |
| | Water | 300 |
| | Duponol | 0.1 |
| Composition B | Malachite green lactone | 6 |
| | Methylhydroxypropyl-cellulose | 8 |
| | Fatty acid amid S | 24 |
| | Water | 120 |
| | Duponol | 0.1 |

Compositions A and B were thoroughly mixed together and coated on a polyester film with a Meyer bar to provide a coating of 5 g/m$^2$ in the dry state.

After drying the film was exposed to x-ray radiation and provided a dark green contrast with a maximum density of 1.2 under the following conditions:

| | |
|---|---|
| Distance to the source | 50 cm |
| Voltage | 150 KV |
| Current | 6 mA |
| Exposure time | 2 sec. |
| Development temperature | 100-200 C. |
| Development speed | 6 cm/sec. |

I claim:

1. A photosensitive article comprising a substrate coated with a layer of a photosensitive composition including:

a photodissociable choline chloride which is sensitive to x-rays or radiation of shorter wavelength, at least one image-forming compound capable of producing a dye by reaction with the dissociation product of the choline compound, a water soluble polymeric binder, and a low melting point wax for heat development.

2. The article according to claim 1, wherein:

said image-forming compound comprises crystal violet lactone, malachite green lactone, pyridyl blue, leucauramine, 3,3-bis(paradimethylaminophenol), 4,5,6,7 tetrachlorophthalide, 3-ethylamino-6-chlorofluoran, or 3-pyrrolidino-6-methyl-7-anilinofluoran, or said binder comprises polyvinylalcohol, hydroxyethylcellulose, methylcellulose, isopropylcellulose, carboxymethylcellulose, starch, gelatin, casein, gum arabic, polystyrene latex, polyacrylate latex or polyvinylactate latex, or, the heat development material comprises a low melting point fatty acid amide wax or fatty acid salt wax, or wherein the photosensitive composition further includes at least one lubricant comprising zinc stearate, zinc naphthenate, lead naphthenate, barium stearate or barium naphthenate, and at least one pH adjusting material comprising an aliphatic amine.

3. The article according to claim 1, wherein the photosensitive composition is coated on a paper substrate.

4. The article according to claim 1, wherein the coating weight of the layer of photosensitive composition is in the range from about 0.5 to about 5 g per square meter.

5. A process for producing an x-ray image, comprising exposing an article according to claim 1 imagewise to x-rays, and heating the exposed article to develop the image.

6. The process according to claim 5, wherein the exposed article is heated to a temperature in the range of from about 100° C. to about 200° C. for a time in the range from about 0.5 to about 10 sec.

7. The article according to claim 2, wherein the photosensitive composition is coated on a paper substrate.

8. The article according to claim 2, wherein the coating weight of the layer of photosensitive composition is in the range from about 0.5 to about 5 g per square meter.

9. The article according to claim 3, wherein the coating weight of the layer of photosensitive composition is in the range from about 0.5 to about 5 g per square meter.

10. The article according to claim 1, wherein the photodissociable choline chloride is in the crystalline state and has an average particle size less than 5 $\mu$m.

11. The article according to claim 1, wherein the image forming compound is lactone or a compound which reacts with a weak acid to form a dye.

12. The article according to claim 1, wherein the image-forming compounds are phthalide, leucauramine or fluoran compounds.

13. The article according to claim 1, wherein the image forming compound is pyridyl blue which is a mixture of isomers selected from the group consisting of 7-(1-ethyl-2-methyl-3-yl)-7-(4-diethylamino-2-ethoxyphenyl)-5,7-dihydrofuro(3,4b) pyridin-5-one, and 5-(1-ethyl-2-methylindol-3-yl)-5-(4-diethylamino-2-ethoxyphenyl)-5,7-dihydrofuro(3,4b) pyridin-7-one.

14. The article according to claim 1, further comprising sensitivity improvers selected from the group consisting of $Pb_2O_3$ and $UO_2$.

15. The article according to claim 1, further comprising a surfactant.

16. The article according to claim 1, further comprising a filler selected from the group consisting of titanium dioxide, zinc oxide, calcium carbonate, silicon dioxide and aluminum trioxide.

17. A photosensitive article comprising a substrate coated with a layer of a photosensitive composition including:

a photodissociable choline chloride which is sensitive to x-rays or radiation of shorter wavelength, at least one image-forming compound capable of producing a dye by reaction with the dissociation product of the choline chloride compound selected from the group consisting of crystal violet lactone, malachite green lactone, pyridyl blue leucauramine, 3,3-bis(paradimethylaminophenol), 4,5,6,7 tetrachlorophthalide, 3-ethylamino-6-chlorofluoran, and 3-pyrrolidino-6-methyl-7-anilinofluoran, a water soluble polymeric binder selected from the group consisting of polyvinylalcohol, hydroxyethylcellulose, methylcellulose, isopropylcellulose, carboxymethylcellulose, starch, gelatin, casein, gum arabic, polystyrene latex, polyacrylate latex or polyvinylactate latex, a low melting point fatty acid amide wax for heat development, at least one lubricant selected from the group consisting of zinc stearate, zinc naphthenate, lead naphthenate, barium stearate and barium naphthenate, and at least one pH adjusting material containing an aliphatic amine.

18. A photosensitive composition, comprising:

a photodissociable choline chloride which is sensitive to x-rays or radiation of shorter wavelength, at least one image-forming compound capable of producing a dye by reaction with the dissociation product of the choline choride, a water soluble polymeric binder, and a low melting point wax for heat development.

19. The composition according to claim 1, wherein:

said image-forming compound comprises crystal violet lactone, malachite green lactone, pyridyl blue, leucauramine, 3,3-bis(paradimethylaminophenol), 4,5,6,7 tetrachlorophthalide, 3-ethylamino-6-chlorofluoran, or 3-pyrrolidino-6-methyl-7-anilinofluoran, or said binder comprises polyvinylalcohol, hydroxyethycellulose, methylcellulose, isopropylcellulose, carboxymethylcellulose, starch, gelatin, casein, gum arabic, polystyrene latex, polyacrylate latex or polyvinylactate latex, or said heat development material comprises a low melting point fatty acid amide wax or a fatty acid salt wax or wherein the photosensitive composition further includes at least one lubricant comprising zinc stearate, zinc naphthenate, lead naphthenate, barium stearate or barium naphthenate, and at least one pH adjusting material comprising an aliphatic amine.

* * * * *